US010355513B2

(12) United States Patent
Sanahyan

(10) Patent No.: US 10,355,513 B2
(45) Date of Patent: Jul. 16, 2019

(54) MULTI-FUNCTION CONTAINER FOR MODIFYING TEMPERATURE OF AN OBJECT

(71) Applicant: Vigen Sanahyan, Yerevan (AM)

(72) Inventor: Vigen Sanahyan, Yerevan (AM)

(73) Assignee: YE US.Inc, Wilmington (DE)

( * ) Notice: Subject to any disclaimer, the term of this patent is extended or adjusted under 35 U.S.C. 154(b) by 222 days.

(21) Appl. No.: 15/430,495

(22) Filed: Feb. 12, 2017

(65) Prior Publication Data

US 2017/0299260 A1 Oct. 19, 2017

(51) Int. Cl.

| | |
|---|---|
| ***F25D 31/00*** | (2006.01) |
| ***H02J 7/02*** | (2016.01) |
| ***B65D 81/18*** | (2006.01) |
| ***B65D 41/02*** | (2006.01) |
| ***B65D 25/02*** | (2006.01) |
| ***F25B 21/04*** | (2006.01) |
| *H02J 50/00* | (2016.01) |

(52) U.S. Cl.

CPC ..... *H02J 7/025* (2013.01); *B65D 25/02* (2013.01); *B65D 41/02* (2013.01); *B65D 81/18* (2013.01); *F25B 21/04* (2013.01); *F25B 2321/0212* (2013.01); *H02J 50/00* (2016.02)

(58) Field of Classification Search

CPC ..... F25D 31/002; F25B 21/00; F25B 21/02; F25B 21/04; F25B 2321/00; A47G 19/027; A47G 19/2288

See application file for complete search history.

(56) References Cited

U.S. PATENT DOCUMENTS 5,243,684 A * 9/1993 Edwards ..... A47J 31/005 219/436

7,417,417 B2 * 8/2008 Williams ..... A47G 19/2227 206/459.1

(Continued)

*Primary Examiner* — Brian M King

(57) ABSTRACT

Disclosed is container for modifying temperature of an object on receiving commands from a computing device. The container includes a hollow outer vessel, a hollow inner vessel, a hollow cylindrical bracket, a first temperature sensor, a peltier element, a heat sink, a second temperature sensor, a battery, a printed circuit board, a memory unit, a microprocessor, a bi-directional communication unit, and a bottom cover. The hollow cylindrical bracket is having a first indent, a second indent, a sidewall, and a closed bottom end. The hollow bracket sidewalls move between the second outer surface and the first inner surface. The first temperature sensor measures temperature of the second outer surface of the inner vessel. The memory unit stores pre-defined reference temperature. The microprocessor processes signals received from the first temperature sensor and the second temperature sensor. The microprocessor regulates current and voltage for the peltier element depending upon the processed signals and the stored pre-defined reference temperature. The bi-directional communication unit communicates signals between the microprocessor and the computing device. The computing device sends command to the controller to regulate the temperature of the inner vessel. The bottom cover covers the battery and the printed circuit board. Further, the bottom cover attaches to the hollow bracket.

6 Claims, 3 Drawing Sheets

(56) References Cited

U.S. PATENT DOCUMENTS

| | | | | |
|---|---|---|---|---|
| 7,997,786 | B2 * | 8/2011 | Liu | A47J 27/004<br>219/438 |
| 8,621,885 | B1 * | 1/2014 | Niebolte | F25D 31/002<br>62/457.4 |
| 2002/0175158 | A1 * | 11/2002 | Sanoner | A47G 19/2227<br>219/387 |
| 2005/0121431 | A1 * | 6/2005 | Yuen | A47G 19/2288<br>219/387 |
| 2015/0245723 | A1 * | 9/2015 | Alexander | A47G 19/027<br>99/483 |

* cited by examiner

MULTI-FUNCTION CONTAINER FOR MODIFYING TEMPERATURE OF AN OBJECT

CROSS REFERENCE TO RELATED APPLICATION

The present application takes priority from an application filed in Intellectual Property Agency of the Republic of Armenia with the application number AM20160033 filed on Apr. 14, 2016, which is incorporated herein by reference.

BACKGROUND OF THE INVENTION

1. Field of the Invention

The present invention generally relates to a multi-function container, and more particularly relates to a multi-function container for modifying temperature of an object on receiving commands from a computing device.

2. Description of Related Art

Many containers are provided for storage of foods solid and liquid, such containers as a thermos apply many elements to retain either a cooling effect to keep foods cold or a thermal area to retain heat as to keep foods warm. Most of these containers can only keep food stored and warm for a certain period of time. As with many thermos style containers the space provided between the walls of the outer and inner receptacles is for retaining heat to warm the contents.

There are devices known in the art that communicates with the container wirelessly. Further, these containers contain sensors to measure the temperature. However, these devices are complex due to the existence of separate blocks for heating and cooling. Further, these containers are dependent upon external electrical power that creates discomfort during the usage and doesn't apply for bicycle travelers and pedestrian tourists.

Further, the existing devices are remote control and are not wireless and thus dramatically limits the device feature and usability. Therefore, there is a need of a container for modifying temperature of an object on receiving commands from the computing device. Further, the container should be able to illuminate light signals depending upon the temperature of the object.

SUMMARY OF THE INVENTION

In accordance with teachings of the present invention, a container for modifying temperature of an object on receiving commands from a computing device is provided.

An object of the present invention is to provide a container for modifying temperature of an object on receiving commands from a computing device. The container includes a hollow outer vessel, a hollow inner vessel, a hollow cylindrical bracket, a first temperature sensor, a peltier element, a heat sink, a second temperature sensor, a battery, a printed circuit board, a memory unit, a microprocessor, a bi-directional communication unit, and a bottom cover.

The hollow outer vessel is having a first outer surface, a first inner surface, a first top surface, and an open first bottom surface. The hollow inner vessel is configured inside the hollow outer vessel. The hollow inner vessel is having second outer surface, a second inner surface, a second top surface and a closed second bottom surface. The first top surface is attached to the second top surface is to prevent heat dissipation.

The hollow cylindrical bracket is having a first indent, a second indent, a sidewall, and a closed bottom end. The hollow bracket sidewalls move between the second outer surface and the first inner surface. The first temperature sensor measures temperature of the second outer surface of the inner vessel.

The peltier element generates energy to maintain temperature of the hollow inner vessel. The heat sink controls the temperature of the peltier element. The second temperature sensor measures the temperature of the heat sink. The battery powers the heat sink, the first sensor, the second sensor and the peltier element.

The printed circuit board controls the transfer of electrical energy received from the battery. The memory unit stores pre-defined reference temperature. The microprocessor processes signals received from the first temperature sensor and the second temperature sensor. The microprocessor regulates current and voltage for the peltier element depending upon the processed signals and the stored pre-defined reference temperature.

The bi-directional communication unit communicates signals between the microprocessor and the computing device. The computing device sends command to the controller to regulate the temperature of the inner vessel. The bottom cover covers the battery and the printed circuit board. Further, the bottom cover attaches to the hollow bracket.

These and other features and advantages will become apparent from the following detailed description of illustrative embodiments thereof, which is to be read in connection with the accompanying drawings.

DETAILED DESCRIPTION OF DRAWINGS

Figure 1:
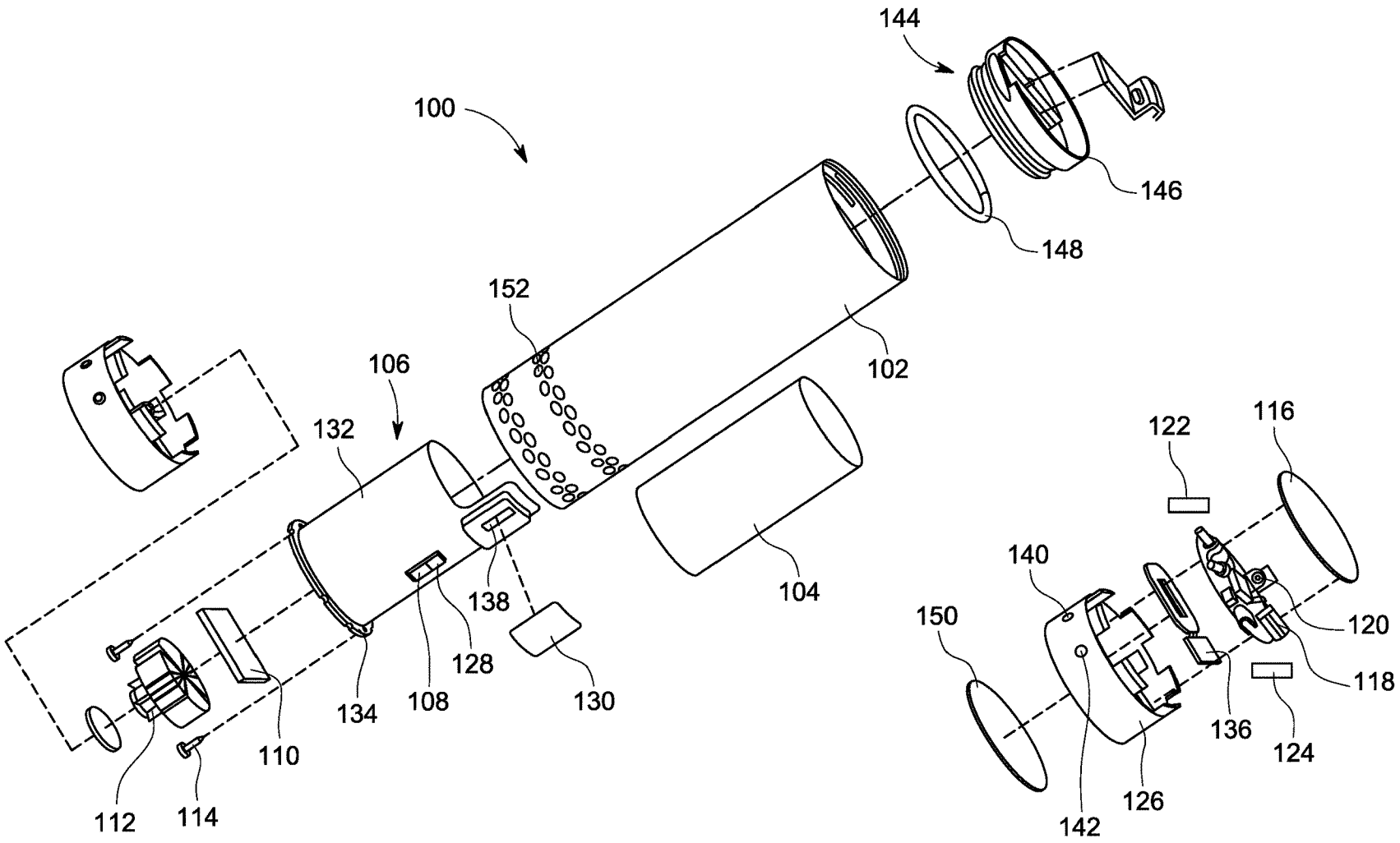
FIG. 1 illustrates an exploded view of a container for modifying temperature of an object in accordance with a preferred embodiment of the present invention.

While this technology is illustrated and described in a preferred embodiment container for modifying temperature of an object on receiving commands from a computing device may be produced in many different configurations, shapes, sizes, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

FIG. 1 illustrates an exploded view of a container 100 for modifying temperature of an object in accordance with a preferred embodiment of the present invention. The container 100 includes a hollow outer vessel 102, a hollow inner vessel 104, a hollow cylindrical bracket 106, a first temperature sensor 108, a peltier element 110, a heat sink 112, a second temperature sensor 114, a battery 116, a printed circuit board 118, a memory unit 120, a microprocessor 122, a bi-directional communication unit 124 and a bottom cover 126.

Figure 2:
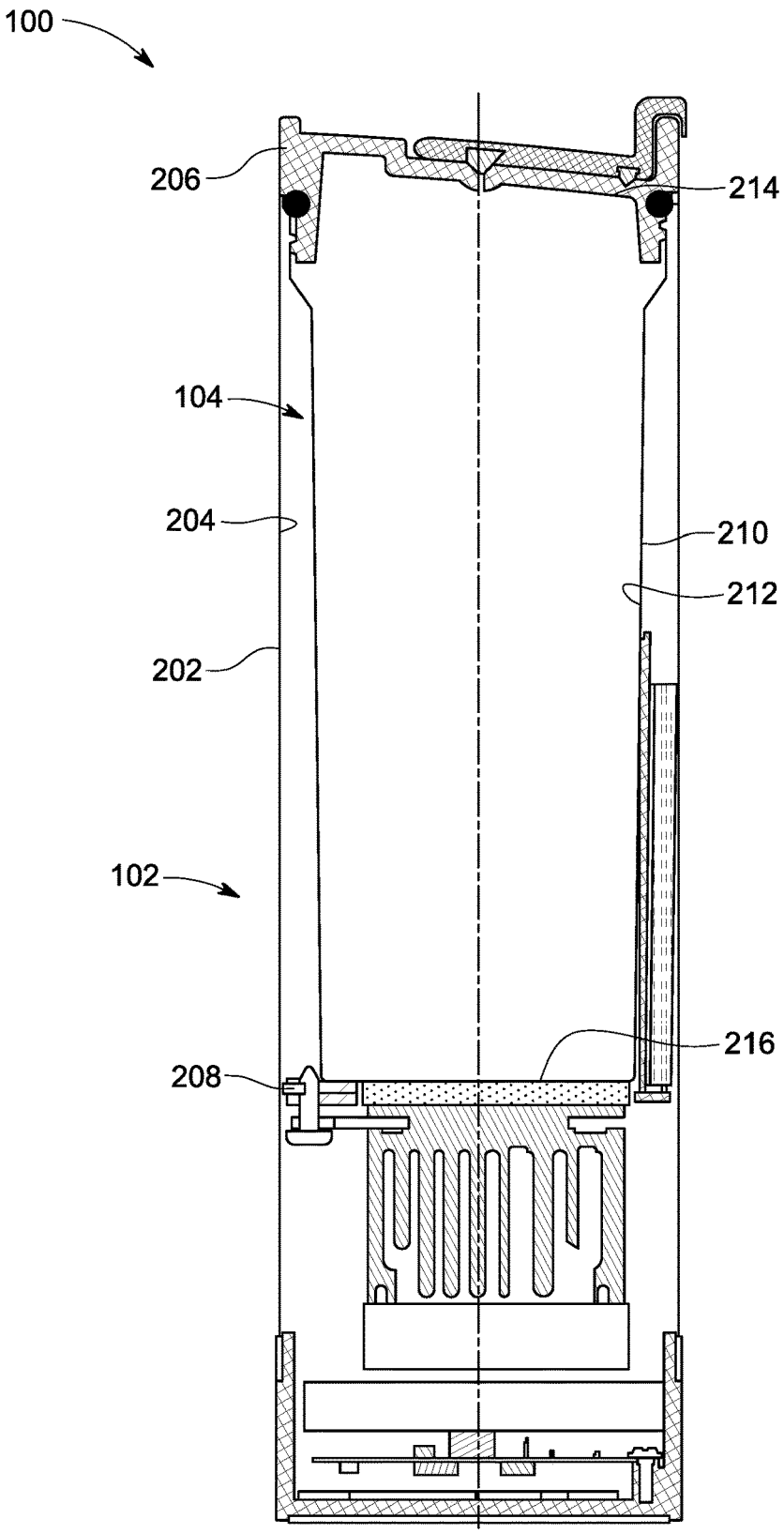
FIG. 2 illustrates a front sectional view of the container in accordance with a preferred embodiment of the present invention.

The hollow outer vessel 102 and the hollow inner vessel 104 are explained in detail in conjunction with FIG. 2 of the present invention. The hollow cylindrical bracket 106 includes a first indent 128, a second indent 130, sidewalls 132 and a closed bottom end 134. The position of sidewalls 132 are shown and explained in detail in conjunction with FIG. 2 of the present invention.

The first temperature sensor 108 is configured on the first indent 128 of the hollow cylindrical bracket 106 to measure temperature of the inner vessel 104. The peltier element 110 is configured inside the hollow cylindrical bracket 106 for generating energy to maintain temperature of the hollow inner vessel 104.

The heat sink 112 is configured to be placed on top of the closed bottom end 134 and below the peltier element 110. The heat sink 112 controls the temperature of the peltier element 110. The second temperature sensor 114 is configured to measure the temperature of the heat sink 112.

Examples of the peltier element 110 includes but not limited to TEC1-12706 Heatsink Thermoelectric Cooler, 12V 6A 72W TEC1-12706 Thermoelectric cooler. In another preferred embodiment of the present invention, the heat sink 112 includes a fan. Examples of the heat sink 112 include but not limited to TTC-CUV3AB (DIY), cooper based heat sink with fan. Examples of object include but not limited to liquid, solid, and other similar food items.

The battery 116 powers the heat sink 112, the first sensor 108, the second sensor 114 and the peltier element 110. The printed circuit board 118 controls the transfer of electrical energy received from the battery 116. The memory unit 120 is connected to the printed circuit board 118 to store a pre-defined reference temperature.

The microprocessor 122 is connected to the printed circuit board 118 and the memory unit 120. The microprocessor 122 processes the signals received from the first temperature sensor 108 and the second temperature sensor 114. The microprocessor 122 regulates current and voltage of the peltier element 110 depending upon the processed signals and the stored pre-defined reference temperature.

The bi-directional communication unit 124 is connected to the printed circuit board 118 to communicate signals between the microprocessor 122 and the computing device. The computing device sends command to the microprocessor 122 to regulate the temperature of the hollow inner vessel 104. The bottom cover 126 covers the battery 116 and the printed circuit board 118. The bottom cover 126 attaches to the hollow cylindrical bracket.

Examples of the memory unit 120 include but not limited to flash memory with minimum storage of 256Kb. Examples of the bi-directional communication unit 124 includes but not limited to wi-fi, Bluetooth, Infrared etc. Examples of the microprocessor 122 include but not limited to nrf51822, ATMEGA48-20AU etc.

Examples of the computing device includes but not limited to a smartphone, computer etc. For exemplary purposes, users are able to operate the container 100 using smartphones. The users may send command of heating or cooling the object inside the container wirelessly using the smartphones.

In another preferred embodiment of the present invention, the container 100 includes a wireless charger 136 to receive power from a wireless charging station to charge the battery 116. The container 100 includes a multiple light emitting diode 138 emits light from the second indent 130 of the hollow cylindrical bracket 132. The multiple light emitting diode 138 emits light depending upon the temperature of the hollow inner vessel 104 measured by the first temperature sensor.

The multiple light emitting diode 138 is controlled by the microprocessor 122. Example of the multiple light emitting diode 138 includes but not limited to sk6812 mini light emitting diode, similar in-built IC LED etc. The multiple light emitting diode 138 is explained in detail in conjunction with FIG. 3 of the present invention.

In another preferred embodiment of the present invention, the container 100 includes a first button 140 and a second button 142. The first button 140 is configured on the bottom cover 126 and further connected to the microprocessor 122 to cool the temperature of the hollow inner vessel 104.

The second button 142 is configured on the bottom cover 126 and is further connected to the microprocessor 122 to heat the hollow inner vessel 104. The container 100 further includes a seal cap 144 for closing the top surface of the hollow inner vessel 104 and the hollow outer vessel 102.

The seal cap 144 may include a lid 146 to close the top surface of the hollow inner vessel 104 and the hollow outer vessel 102 to prevent heat dissipation. The seal cap 144 further includes a rubber seal 148 to tightly secure the lid on the hollow inner vessel 104 and the hollow outer vessel 102.

In accordance with another preferred embodiment of the present invention, the container 100 further includes a matt 150 is placed on the bottom of the bottom cover 126; and plurality of holes 152 on the hollow outer vessel 102 for allowing ventilation of air.

FIG. 2 illustrates a front sectional view of the container 100 in accordance with a preferred embodiment of the present invention. The hollow outer vessel 102 includes a first outer surface 202, a first inner surface 204, a first top surface 206 and an open first bottom surface 208.

Similarly, the hollow inner vessel 104 includes a second outer surface 210, a second inner surface 212, a second top surface 214, and a closed second bottom surface 216. The first top surface 206 and the second top surface 216 are attached to prevent heat dissipation. In a preferred embodiment the first top surface 206 and the second top surface 214 are welded together.

The hollow cylindrical bracket 106 sidewalls 132 move between the second outer surface 210 and the first inner surface 204. The hollow cylindrical bracket 106 locks between the hollow outer vessel 102 and the hollow inner vessel 104. The hollow outer vessel 102 and the hollow inner vessel 104 are cylindrical in shape.

Figure 3:
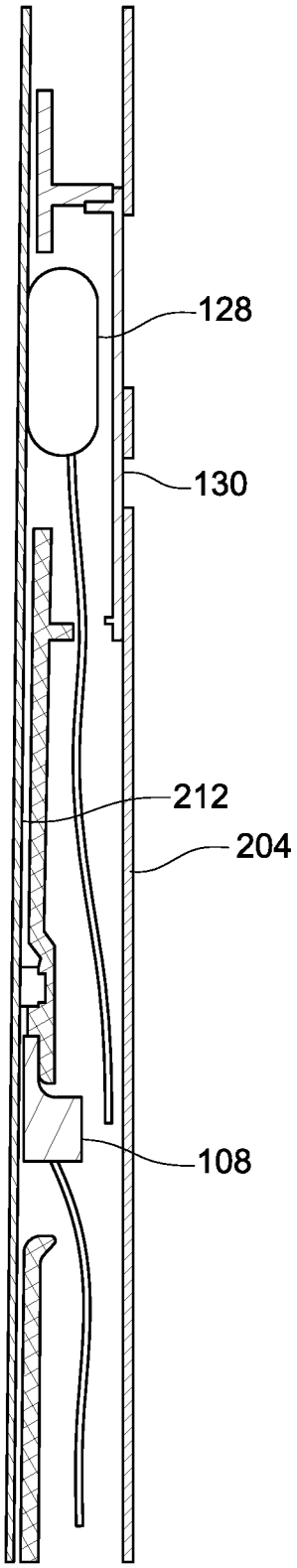
FIG. 3 illustrates a front sectional view of second outer surface and the first inner surface in accordance with a preferred embodiment of the present invention.

FIG. 3 illustrates a front sectional view of second outer surface 212 and the first inner surface 204 in accordance with a preferred embodiment of the present invention. The multiple light emitting diode 138 is positioned between the first inner surface 204 and the second outer surface 204. The multiple light emitting diode 128 is illuminated through the second indent 130.

The first temperature sensor 108 measures the temperature of the second inner surface 212 and thus controls the multiple light emitting diode 128 through the microprocessor. The first temperature sensor 108 sends the signal to the microprocessor and then the microprocessor signals the multiple light emitting diode 128 to reflect the specific light depending upon the measured temperature.

The present invention offers various advantages such as providing varied temperatures to the container using the smartphone. The users are able to set the temperature of the container from 10 degrees Celsius to 70 degree Celsius. Further, the present invention illuminate lights based upon the temperature of the container.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A container for modifying temperature of an object on receiving commands from a computing device, the container comprising:

a hollow outer vessel having a first outer surface, a first inner surface, a first top surface, and an open first bottom surface;

a hollow inner vessel configured inside the hollow outer vessel, the hollow inner vessel having a second outer surface, a second inner surface, a second top surface, and a closed second bottom surface, wherein the first top surface attached to the second top surface to prevent heat dissipation;

a hollow cylindrical bracket having a first indent, a second indent, sidewalls and a closed bottom end, the sidewalls configured between the second outer surface and the first inner surface;

a first temperature sensor configured on the first indent of the hollow cylindrical bracket to measure temperature of the inner vessel;

a peltier element configured inside the hollow cylindrical bracket for generating energy to maintain temperature of the hollow inner vessel;

a heat sink configured to be placed on top of the closed bottom end and below the peltier element, the heat sink controls the temperature of the peltier element;

a second temperature sensor configured to measure the temperature of the heat sink;

a battery to power the heat sink, the first sensor, the second sensor and the peltier element;

a printed circuit board controls the transfer of electrical energy received from the battery;

a memory unit connected to the printed circuit board to store a pre-defined reference temperature;

a microprocessor connected to the printed circuit board and the memory unit, the microprocessor processes the signals received from the first temperature sensor and the second temperature sensor, further the microprocessor regulates current and voltage for the peltier element depending upon the processed signals and the stored pre-defined reference temperature;

a bi-directional communication unit connected to the printed circuit board to communicate signals between the microprocessor and the computing device, wherein the computing device sends command to the microprocessor to regulate the temperature of the hollow inner vessel; and a bottom cover covers the battery and the printed circuit board, further the bottom cover attaches to the hollow cylindrical bracket.

2. The container according to claim 1 further comprising a wireless charger to receive power from a wireless charging station to charge the battery.

3. The container according to claim 1 further comprising a multiple light emitting diode to emit light from the second indent of the hollow cylindrical bracket, the multiple light emitting diode emits light depending upon the temperature of the hollow inner vessel measured by the first temperature sensor, wherein the multiple light emitting diode is controlled by the microprocessor.

4. The container according to claim 1 further comprising a first button configured on the bottom cover and further connected to the microprocessor to cool the temperature of the hollow inner vessel; and a second button configured on the bottom cover to heat the hollow inner vessel.

5. The container according to claim 1 further comprising a seal cap to close the top surface of the hollow inner vessel and the hollow outer vessel.

6. The container according to claim 1 further comprising plurality of holes on the hollow outer vessel for allowing ventilation of air.

* * * * *